US006394456B1

(12) United States Patent
Long

(10) Patent No.: US 6,394,456 B1
(45) Date of Patent: May 28, 2002

(54) METHOD OF PLAYING A VARIATION OF THE CARD GAME "TWENTY-ONE"

(76) Inventor: George M. Long, 9315 SW. 144th St., Miami, FL (US) 33176

( * ) Notice: Subject to any disclaimer, the term of this patent is extended or adjusted under 35 U.S.C. 154(b) by 0 days.

(21) Appl. No.: 09/461,639

(22) Filed: Dec. 14, 1999

Related U.S. Application Data

(63) Continuation-in-part of application No. 09/028,942, filed on Feb. 24, 1998, now Pat. No. 6,000,699.

(51) Int. Cl.[7] ..... A63F 1/00
(52) U.S. Cl. ..... 273/292
(58) Field of Search ..... 273/292, 274, 273/309; 463/12, 13

(56) References Cited

U.S. PATENT DOCUMENTS 4,861,041 A * 8/1989 Jones et al. ..... 273/292
5,275,416 A * 1/1994 Schorr et al. ..... 273/292
6,000,699 A * 12/1999 Long ..... 273/292

OTHER PUBLICATIONS

Mavarick Blackjack, May 2, 1995.*

* cited by examiner

*Primary Examiner*—Benjamin H. Layno
(74) *Attorney, Agent, or Firm*—Malloy & Malloy, P.A.

(57) ABSTRACT

A method of playing the card game of twenty-one or "Black JacK' involving a variation which allows a player to place a side wager in addition to the initial wager or ante, wherein the side wager allows the player to win at least a portion of a supplemental payout, which may be a predetermined amount depending upon an amount of a wager and/or the cards of the player's and dealer's hands, or may be derived from a progressively increasing wager pool, if one or more hands of the player have a final number count which ties the final number count of the dealer's hand, and a further increased payout if the cards that comprise the dealer's hand identically match the cards that comprise the player's hand. The player also has the opportunity to concurrently play additional hands, each of which may also be eligible to participate in at least a portion of the supplemental payout if any one or all of the additional hands have a final number count equal to the final number count of the dealer hands. The player's additional hands are created by "splitting" initial and successive cards dealt the player if such cards are the same numerical count.

11 Claims, No Drawings

METHOD OF PLAYING A VARIATION OF THE CARD GAME "TWENTY-ONE"

The present application is a continuation-in-part application of previously filed, now pending application having Ser. No. 09/028,942 filed on Feb. 24, 1998 now U.S. Pat. No. 6,000,699.

BACKGROUND OF THE INVENTION

1. Field of the Invention

This invention is directed to a method of playing a variation of the card game twenty-one comprising allowing a player to make a side bet in addition to his initial ante bet in order to be eligible for a supplemental payout if the final number count of the player's hand is equal to the final number count of the dealer's hand. The player, with or without the aforementioned side bet, is allowed to participate in the normal payout under the conventional rules of the game of twenty-one.

2. Description of the Related Art

The card game of twenty-one, also known as "Black Jack" is a game found being played at most casinos or gaming establishments and is extremely popular with many players regardless of their economic level of play. This popularity is due in part to the simplicity of the game as well as the fact that under certain conditions, the odds of winning may vary greatly, frequently favoring the player instead of the casino or "house".

Under the conventional rules of the game of twenty-one, the goal of the game is for one or more player's to achieve a hand which has a final number count closer to 21, without exceeding 21, than the final number count of the dealer's hand. Each card dealt contributes to the final number count in accordance with its face value, except all face cards count as 10 and an ace may count as either 1 or 11. The play of the game involves each player, as well as the dealer, receiving a first of two cards. Depending upon the particular rules of a given casino or gaming establishment, the first card dealt the dealer normally represents his "up" card and is dealt to him face up. The second card dealt the dealer is considered his "hole" card and is presented to the dealer face down, usually during a normal deal or after the players have concluded their hands. Furthermore, depending upon the particular house rules, each of the first two cards dealt the player may be face up or face down. In establishing the final number count and attempting to come as close to 21 as possible without exceeding 21, both the players and the dealers are allowed to "stand" on the number count of their first two cards or receive additional cards or "hits". Each player may stand or hit on any number count of the first two cards. However, if any player decides to take additional cards or "hits" such player "busts" if the final number count exceeds 21. Any player's or dealer's hand that "busts" is considered a loosing hand and is removed from consideration in the further play of the game. The dealer is normally placed under the additional requirement of being forced to take one or more hits if his number count is under 17. If the final number count of the first two cards dealt the dealer is between 17 and 21, the dealer is generally prohibited from taking a hit unless house rules provide otherwise.

Typical betting involved under the conventional rules of the game of twenty-one require each player to make an original wager or ante. The player wins the amount of his initial wager from the house if the final number count of his hand is greater than that of the dealer's hand without exceeding 21 or if the dealer busts. If the player receives a "Black Jack" or reaches the final number count of 21 with his first two cards, he is paid a greater amount than his initial wager, normally in the range of one and one-half to two times the initial wager.

One advantage of the house which exists in the conventional play of the game is that the dealer shows his total number count of his first two cards only after all the players decide to stand, take hits or bust. As a result one or all of the players may be eliminated prior to the dealer determining his final number count. After all of the players have taken hits or have decided to stand on their hands, the dealer "stands" or "hits" based on the conventional rules of the game subject to any modification by the casino or house. After the final number count of the dealer's hand has been established, it is compared to the final number count of the hands of the existing players. All player's hands having a final number count closer to the 21 than that of the dealer win in accordance with the conventional or normal payout, based on their initial ante or wager, as set forth above.

There are other variations normally found and accepted under the conventional rules of casino twenty-one. Such variations include the well-known procedure of splitting pairs. If the player's first two cards are pairs, meaning that they have the same numerical count, they may be "split" thereby giving the player the opportunity to create two hands. The player is normally required to put up an additional ante bet equal in amount to his initial wager or ante and is thereafter dealt a second two cards, with the second card of one of the hands either being dealt immediately, or after the first hand is played out, depending upon the house rules. Each of the second two cards is applied to a different one of the split cards so as to form two complete hands for the player. The player then proceeds in his play by standing or taking hits on each of the two hands as set forth above. In most casinos the player is given the added opportunity of creating even more hands if either or both of the second two cards dealt the player also has the same number count as the split pair of cards. There is normally a limit of 3 or 4 additional hands that may be created by splitting cards, however, the number of splits possible may be any amount desired by the house.

Other variations normally accepted under the conventional rules of twenty-one include allowing a player to "double down" if he is holding a total number count of 10 or 11. The player may double his original wager and take only a single additional hit. The player is not allowed to take additional hits in order to increase his final number count. If the player's final number count is closer to 21 than that of the dealer's hand, he wins the total amount wagered.

Yet another accepted version under the conventional rules of twenty-one involves "insurance" wherein the player may make an insurance bet, often equal to half of his initial ante or wager if the face card of the dealer's hand is an ace. If the dealer's hand reaches the number count of 21 with his first two cards, the player looses his initial ante or wager, unless the player also has a natural 21, but receives twice the amount of his insurance bet.

These and other variations are generally accepted in playing conventional casino twenty-one in order to make the game more exiting and seemingly more attractive from a payout standpoint to the player. However, in order to increase the popularity of the game by raising the excitement level of the players, additional variations in the method of play, not normally considered within the conventional rules, have been proposed. Such variations include the creation of a progressive jackpot or payout, at least a portion of which is paid to a player who obtains certain, predetermined arrangements of cards, in his first two cards or first successively dealt number of cards. Other modifications or variations involve allowing a player to modify his wager and/or make a side bet so he may selectively choose to bet that either a player's hand or a dealer's hand will be the winning hand. Other unconventional "side bet" variations of the game involve the player making a side wager on the number of hits that the players and/or the dealers will ultimately take. In addition, a player may make a side bet on whether he will receive a "stiff" hand wherein the term "stiff" is defined as occurring when the first two cards dealt to a player have a total number count of 12 to 16 or whether the player will be dealt either a non-pair "stiff" hand or a pair of aces. Yet other variations include allowing a player to play the same hand against multiple and/or successively dealt hands of the dealer thereby potentially giving the player an odds advantage.

While the above noted "unconventional" variations of the method of play of the game of twenty-one are suggested to increase the attractiveness of the game to players, the result generally has been the opposite. Such a lack of acceptance of these variations is due at least in part to the modified method of play being overly complex or frequently resulting in the odds of winning swinging strongly in favor of the casino or house. Also, such unconventional variations frequently involve extensive modification and redesign of the gaming surface as well as the inclusion of certain mechanical and/or electronic hardware and software facilities which of course add to the expense of maintaining and playing the game.

Therefore, even though the card game of twenty-one, particularly as played live in casinos or like gaming establishments, enjoys great popularity with players, there is still a need for a variation of the method of play wherein a player may render his hand eligible for a supplemental payout which, under certain circumstances may be a payout based on a progressively increasing wager pool if the player's hand meets certain criteria. In addition, such a preferred variation should allow continuance of the player's hand in order to win his initial ante or wager under the conventional rules of twenty-one.

SUMMARY OF THE INVENTION

The present invention is directed to a method of playing the card game twenty-one involving a variation which allows one or more players to participate in the game in the conventional fashion, while preferably allowing each player the opportunity to render his hand eligible for a supplemental payout in the event the final number count of the player's hand or hands results in a tie or "push" with the final number count of the dealer's hand. For example, in one embodiment, a player has the opportunity to make an additional wager, making themselves eligible for the supplemental payout. Alternatively, however, the game could be structured such that all players playing according to the method of the present invention are automatically eligible for a supplemental payout in the case of a "push". Of course, as will be described, in such an embodiment, the supplemental payout preferably comprises an even money payout for the push, which normally would not pay anything. In such an embodiment, additional modifications to the general method of playing the game, as will be described, are also preferably included so as to maintain acceptable payout odds for the house.

Additionally, in the method of the present invention, the player may be given the opportunity to increase the number of hands he may play by splitting pairs in the conventional fashion. The initial hand of the player or the resulting additional hands caused by "splitting pairs" is eligible for a supplemental payout provided the player makes a side wager for his initial hand and, in a preferred embodiment, makes an additional side bet for each hand he wishes to consider eligible for the supplemental payout in the event of a push.

Payout for accomplishing the resulting push of the dealer's hand is dependent upon the number of tying hands held by the player when the variation of "splitting pairs" is taken advantage of. Further, the payout may be greatly magnified by creating a progressively increasing wager pool which is paid out in full or in part dependent upon the number of winning or "push" hands held by a player. The progressive wager pool can be created by contributing a predetermined percentage of each side wager made by all players making such side wagers. Once the requisite number of hands are held and won by a player, (all hands held by player define a push of the dealer's hands) all or substantially all of the progressively increasing wager pool is paid resulting in an extremely large supplemental payout. The progressive wager pool is then reestablished by again contributing a predetermined percentage of each side wager made by all players making such side wagers until the progressive wager pool is again depleted by at least one player achieving a requisite number of push hands.

Supplemental payouts other than that accomplished by winning all or a portion of a progressive wager pool would be predetermined and would increase by acceptable multiples depending upon the number of tying hands (hands that push the dealer's hand). The supplemental payout equalling all or a significant portion of the progressive wager pool would be reserved for situations where all of the player's split hands were tying or push hands when compared to the final number count of the dealer's hand.

The variation of the method of play of the game of twenty-one in accordance with certain additional embodiments of this invention would include the determination of the amount of the progressive wager pool to be paid, being dependent upon other factors in combination with the fact that a predetermined number of the player's hands resulted in winning or "push" hands. These other factors would include the amount of the payout and/or the realization of a greatly magnified payout being based on allowing the player to perform at least one roll of dice wherein the number count of the resulting dice roll and/or whether "doubles" or "triples" were thrown, would determine the amount of the payout.

In yet another embodiment, the amount of the supplemental payout may be determined by a comparison of the dealer's hand with the player's hand. For example, if a push is obtained, but the cards that make up the dealer's hand are not the same numbers (i.e. 2–10, J, Q, K, A) as those cards which make up the player's hand, a certain lesser amount, such as even money, no money, or a defined amount may be paid out. Conversely, however, if the numbers on the cards in the player's hand and the dealer's hand match (ex. Player has an 8 and J, the Dealer has an 8 and J), regardless of suit, an increased supplemental payout would result. Moreover, in those situations wherein the numbers and suits of the player's cards and dealer's cards match, a further increased supplemental payout, of either a fixed amount, or based on one of the alternative determinant methods described herein, could be provided.

Of course, the final number count of the dealer's hand and the one or more hands of the player would preferably be determined by the conventional rules of the game of twenty-one. More specifically, both the dealer and the player would be required to stand, take hits or bust a given hand in accordance with the rules of twenty-one as conventionally played and/or slightly modified by the casino or house regulating the game play.

Therefore, it is an object of the present invention to provide a method of playing a variation of the game of twenty-one which is attractive to players participating, at least from the stand point of the possibility of increased winnings, without detracting from the participation in the game of twenty-one as conventionally played.

Another object of the present invention is to provide a method of playing a variation of the game of twenty-one which is simple, yet exciting and which at least partially conforms to the conventional rules of twenty-one.

Yet another object of the present invention is to provide a method of playing a variation of the game of twenty-one which is fast paced thereby adding to the possible frequency of winning the game in the conventional manner.

These and other objects, features and advantages of the present invention will become more clear when the detailed description of the present invention is taken into consideration.

DETAILED DESCRIPTION OF THE PREFERRED EMBODIMENT

The present invention is directed to a method of playing a variation of the game of twenty-one or "blackjack", wherein each player is given the opportunity for a supplemental payout in the event the final number count of the player's hand results in a tie or "push" with the final number count of the dealer's hand. In addition, in one embodiment of the present invention, in order to be eligible for the supplemental payout, the player must make a side wager, preferably of a predetermined amount or amounts determined by the house, such as within a given range, for each hand he wishes to be considered eligible for the supplemental payout in the event of a push. If the player elects to make the aforementioned side wager, his hand or any additional hands concurrently held by the player are also eligible for the normal payout available when the player's hand has a final number count closer to twenty-one than that of the dealer, without going over. Alternatively, however, as will be described, if desired each player may automatically be made eligible for the supplemental payout according to the house rules.

All hands of the player will be played in the normal fashion or in accordance with the conventional rules of the game of twenty-one. Such rules include any conventional variations such as "doubling down", "splitting pairs", "insurance", etc. Of course, in some circumstances, such as wherein automatic eligibility for the supplemental payout is set, the house wishes to maintain certain odds conditions, or if some other variant to the game is being played, such as "Spanish Twenty-one", a variation of the traditional rules may be acceptable. By way of example, in some embodiments, and preferably in the embodiment wherein each player is automatically eligible for the supplemental payout, it is preferred that the normal odds of winning be reduced to compensate for the additional supplemental payouts to be achieved as a result of the present invention. Such an odds reduction may, for example, include a reduction in the payout for a natural twenty-one from 1.5 to 1. Additionally and/or alternatively, the side wager may be confiscated at all times, whether or not a win, loss or push is received, that side bet/wager being the "fee" for eligibility to the supplemental payout. If desired, and so as to preserve house odds, especially if the supplemental payout will be paid on a push based on the amount of the initial wager, the side wager may be determined as a percentage of the total initial wage, such as $1 for every $10 of the initial wager.

Based upon the preceding, the method of play therefore preferably involves each of the players making an initial wager or ante bet and subsequently receiving, typically along with the dealer, a first two cards. Each player, preferably at this point although the player could be required prior to receiving any cards, preferably has the option of making a side wager, the amount of which may be regulated dependent upon the size of his initial wager. The side wager makes the player's hand eligible for a supplemental payout in the event the final number count of the player's hand results in a push of the final number count of the dealer's hand. In determining the final number count of the hands of the player or players as well as that of the dealer, the conventional rules of the game of twenty-one are generally followed. More specifically, each player and subsequently the dealer may receive additional hits in order to bring the final number count of the respective hands as close to twenty-one as possible without exceeding the final number count of twenty-one which would result in a bust.

In order to further increase the excitement and attractiveness to the player, the method of playing the variation of the present invention further comprises an embodiment wherein the player is allowed to increase the number of hands which he may concurrently play and which may be eligible to receive a supplemental payout in the event the final number count of any one or all of a plurality of hands of the player results in a push of the dealer's hand. This preferred embodiment would allow the player to "split pairs" in accordance with the conventional rules of the game and as a result form additional hands. More particularly, if the first two cards dealt the player had the same numerical count, the player would be allowed to split or separate these two cards and be dealt a second two cards. Each of the second two cards would be combined with a different one of the split cards to allow the player to concurrently play two hands. In "splitting pairs" the player would usually be required to put up a second wager equal in amount to the initial wager or ante bet in accordance with the conventional rules of the game. Also, if desired, the player could then be given the opportunity, or required in some instances, to add an additional side wager which would in turn make both of his hands eligible for a supplemental payout in the event the final number count thereof would equal or push the dealer's hand. As will be described in greater detail hereinafter, the size of the payout would preferably be dependent upon the number of concurrently played hands which resulted in a push of the dealer's hands. Normally, casinos or gaming establishments restrict the number of hands which may be created by "splitting pairs" for a given player. This number usually is a maximum of three or four concurrently held hands by one player. Following the conventional rules of the game of twenty-one a split may occur prior to the player taking any "hits" and each time the player is dealt a card having the same numerical count as the first two split cards. It is to be understood that a player following the conventional rules of the game of twenty-one has a better opportunity for winning or beating the dealer by following what has become recognized as a "basic strategy". This basic strategy is utilized by knowledgeable players, wherein the primary purpose is to determine or establish a final number count closer to twenty-one than that of the final number count of the dealer without busting. The basic strategies further take into consideration the conventional variations of the game of twenty-one set forth above. However, when playing the method involving the variation of the present invention which allows supplemental payoffs in the event of a push, the player may deviate from the aforementioned basic strategy and assume a "maximum push strategy". Such a maximum split strategy may give the player a if better chance of accomplishing a push against the dealer's hand, but in fact may detract from his chances of winning the conventional game of blackjack utilizing a basic strategy. Furthermore, it is important to note that when considering utilizing a basic strategy or a maximum push strategy, a tie in the game of twenty-one occurs once in every 11.46 hands played using basic strategy. Accordingly, a supplemental payoff for a player's hand that accomplishes a push of a dealer's hand may result in a 10 to 1 payout which offers an attractive return to the player but which also provides a moderate house advantage. However, the multiple payout concept is sufficiently attractive that it should attract a substantial number of side bets which may result in a deviation of a player from the basic strategy to the maximum push strategy. Therefore, it should be kept in mind that an opportunity to "split pairs" occurs once in every 13.52 deals, if a 6 deck shoe and basic strategy are utilized. In addition a double tie on splits (both split hands resulting in a push of the dealer's hand) will occur once in every 3,067 deals using 6 decks and a basic strategy. As such, a payoff of possibly 25,000 times the original side bet may initially look very enticing yet provide the house or casino with a desirable odds advantage on a triple or quadruple tie. Based on the above, the following TABLE I provides the odds of various numbers of split hands being held by a player all resulting in a push of the final number count of the dealer's hands using the basic strategy or maximum strategy.

TABLE I

The chance of multiple push varies with playing strategy as follows: (BS = player using basic strategy; MS = player using maximum push strategy)

| # of splits | all ties - BS | all ties - MS |
|---|---|---|
| 4 | 1 in 1,639,000 | 1 in 37,271 |
| 3 | 1 in 96,993 | 1 in 3,762 |
| 2 | 1 in 3,069 | 1 in 314 |

Payoffs of a multiple somewhere between the two factors above are recommended for the various combinations.

In addition, Table II, set forth below represents a potential predetermined payoff amount which could define the supplemental payout, dependent upon the number of split hands which the casino or house allows to be concurrently held by a player.

TABLE II

POTENTIAL PAYOFF SCHEDULE

| | |
|---|---|
| Your first hand ties | 10 to one |
| First split hand ties | 10 to one |
| Second split hand ties | 10 to one |
| Both hands tie | 100 to one |
| Two splits, any one hand ties | 10 to one |
| any two hands tie | 25 to one |
| all three hands tie | 5,000 to one |
| Three splits, any one hand ties | 10 to one |
| any two hands tie | 20 to one |
| any three hands tie | 1,000 to one |
| all four hands tie | 25,000 to one |

To further add excitement to the game, a gigantic progressive payoff could be established in the form of a progressively increasing wager pool which would be created by contributions from a predetermined percentage of each side wager made by each player making such side wagers. A proportion of the progressively increasing wager pool or substantially the entire amount of such wager pool would be paid out or define the supplemental payout in the event all hands, equalling at least three hands held by the player, result in a push of the final number count of the dealer's hand. This is assuming that the casino or house regulating play would allow the creation of three or four hands by one player by the conventional variation of "splitting pairs". Where a casino or house allows splits to more than four hands, additional awards could be developed for the winning of additional numbers of hands but would have to be determined with respect to the individual casino's own rules. Where the house only allows one split, resulting in two hands to a single player, the supplemental payout would be limited, but still be appealing in its potential size. With two splits, the resulting supplemental payout for all three hands pushing the final number count of the hand of the dealer would be quite substantial and in the order of 10,000 to 20,000 to 1 depending upon the playing strategy variations.

Yet another embodiment of the present invention involves all of at least three or four of the player's hands resulting in a final number count equaling the final number count of the dealer's hand. In such an event the player would be eligible to determine the size of the supplemental payout by having at least one roll of dice. In this embodiment, the number count of the dice roll would increase the portion of the supplemental payout by an acceptable, predetermined multiplier. Alternatively, if the number count of two or three dice resulted in "doubles" or "triples" the multiplier would greatly increase based on the fact that odds against rolling "doubles" or "triples" in a single role of the dice is substantial, with a non-doubles roll paying a predetermined lesser amount. Moreover, it is noted that this payout method could also be incorporated into a variety of other casino games.

By way of specific example, a gambler having successfully achieved three pushes in a casino that offers a maximum of three hands may achieve a normal supplemental payout of Two Thousand Five Hundred Dollars. However, using a single roll of two dice, a number of payouts could be established to define the supplemental payout based upon the total number count of the final dice roll or if the production of doubles occurs during the dice roll. If the player rolls the two or three dice resulting in doubles, he wins the larger prize of say Ten Thousand Dollars, and if the player rolls triples an even larger prize results. If doubles or triples are not the result he gets a lesser prize, depending upon the final number count of the dice roll and the odds, which of course are predetermined, of accomplishing that number optionally, a number of predetermined multiples could be used for determining different payoff values.

As yet another alternative embodiment of the present invention, which could be used instead of or in addition to one or more of the previously set forth embodiments, the amount of the supplemental payout could be set to a fixed amount, such as even money based on the players original wager or side bet, unless certain alternate conditions are met. For example, an increased payout could be provided if the numbers (i.e. 2–10, J, Q, K, A) on the cards of the dealer's hand match the numbers on the cards of the player's hand. Accordingly, if the dealer has an 8 and a J, and the player also has an 8 and a J, regardless of suit an increased supplemental could be provided. Moreover, if a "perfect match" situation is achieved, such as when the dealer has an 8 of hearts and a J of spades and the player also has an 8 of hearts and a J of spades, an even further increased supplemental payout could be provided over what normally would have been paid. It is also recognized that if desired, a mere match of suits for corresponding dealer and player cards could also provide for an additional supplemental payout.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A method of playing a variation of the game of twenty-one including a plurality of conventional decks of playing cards, said method comprising:

a) a player making an initial wager to participate in at least a first hand of a conventional game of twenty-one, b) dealing the player the first hand comprising two cards and dealing a dealer's hand, the first hand and the dealer's hand being dealt in accordance with the conventional rules of a game of twenty-one, c) giving the player an opportunity to create one or more additional hands by splitting two or more cards received by the player which have the same numerical count, d) dealing the player a sufficient number of additional cards to form the one or more additional hands in accordance with the conventional rules of the game of twenty-one, e) requiring the player to make a second initial wager for each additional hand formed by splitting cards, f) allowing the player to make a side wager in addition to the first or second initial wager for each of the hands the player wishes to be eligible for a supplemental payout, g) establishing the final number count of all of the player's hands and the dealer's hand in accordance with the conventional rules of the game of twenty-one, h) paying the player at least a portion of the supplemental payout for each of the player's hands on which the side wager was made and that has a final number count of 17 to 21 and is equal to the final number count of the dealer's hand, and i) increasing the amount of the supplemental payout based on more than one of the eligible player's hands equaling the final number count of the dealer's hand.

2. A method as recited in claim 1 comprising increasing the supplemental payout if a value of the individual cards comprising the dealer's hand identically matches a value of corresponding individual cards comprising one or more of the eligible player's hands.

3. A method as recited in claim 1 comprising further increasing the supplemental payout if a suit of the individual cards comprising the dealer's hand identically matches a suit of the corresponding individual cards comprising one or more of the eligible player's hands.

4. A method as recited in claim 3 comprising further determining an amount of the supplemental payout in accordance with an amount of the one or more side wagers.

5. A method as recited in claim 4 comprising further determining the amount of each side wager in accordance with an amount of the initial wager on a corresponding player's hand.

6. A method as recited in claim 1 comprising determining the amount of each side wager in accordance with an amount of the initial wager on a corresponding player's hand.

7. A method as recited in claim 6 comprising confiscating each side wager regardless if a corresponding player's hand wins, losses or ties when compared to the dealer's hand.

8. A method as recited in claim 1 comprising confiscating each side wager regardless if a corresponding player's hand wins, losses or ties when compared to the dealer's hand.

9. A method as recited in claim 1 comprising further determining an amount of the supplemental payout in accordance with an amount of the side wager on a corresponding player's hand.

10. A method as recited in claim 1 comprising determining an amount of the supplemental payout in accordance with an amount of the initial wager on a corresponding player's hand.

11. A method as recited in claim 1 comprising further increasing the supplemental payout if a suit of the individual cards comprising the dealer's hand identically match a suit of the corresponding individual cards comprising one or more of the eligible player's hands.

* * * * *